United States Patent [19]

Keeton

[11] 4,054,204

[45] Oct. 18, 1977

[54] COMPRESSED FOAM ARTICLE

[76] Inventor: Heidi Keeton, 3389 Knollwood Court, Las Vegas, Nev. 89121

[21] Appl. No.: 682,181

[22] Filed: Apr. 30, 1976

Related U.S. Application Data

[62] Division of Ser. No. 535,798, Dec. 23, 1974, Pat. No. 3,968,620.

[51] Int. Cl.[2] ..... B65D 71/00; B65D 77/00

[52] U.S. Cl. ..... 206/83.5; 206/524.8; 428/12; 428/71; 428/310; 428/311

[58] Field of Search ..... 428/68, 69, 71, 76, 428/12, 310, 311, 315; 206/83.5, 205, 232, 497, 523, 524, 524.8, 808; 5/337; 297/DIG. 1; 46/145, 146

[56] References Cited

U.S. PATENT DOCUMENTS

| | | | |
|---|---|---|---|
| 2,647,399 | 8/1953 | Newbill, Jr. | 73/88 |
| 3,521,424 | 7/1970 | Wirfel | 428/311 |
| 3,675,377 | 7/1972 | Suter | 428/311 |

*Primary Examiner*—William J. Van Balen
*Attorney, Agent, or Firm*—Edward J. Quirk

[57] ABSTRACT

An article fabricated from a flexible foam material, such as foam rubber, is compressed by encasing the article in a substantially air-tight sack, and withdrawing air from the sack, thereby reducing the size of the foam article for packaging. The article may be a fabric or plastic covered object, such as a pillow or toy animal; after compression, the object is packaged in a box. The packaged article provides an unusual gift item.

3 Claims, 4 Drawing Figures

COMPRESSED FOAM ARTICLE

CROSS-REFERENCE TO RELATED APPLICATION

This application is a division of application Ser. No. 535,798, filed Dec. 23, 1974, now U.S. Pat. No. 3,968,620.

BACKGROUND OF THE INVENTION

Because of the desirable qualities of flexible foam materials, such as foam rubber or plastic, many novelty and gift items can be easily and inexpensively fabricated from the foam. Pillows, toy animals, and furniture items are easily shaped from foam rubber, either by simply cutting the foam from a larger block of foam, or by stuffing a flexible fabric or plastic casing with smaller pieces of foam until the foam entirely fills the casing. The structural resiliency and lightweight quality of these foams make them adaptable to a wide variety of uses.

However, although many of these foam articles are lightweight, because of their bulk and unusual shapes, packaging is somewhat difficult and shipping is very expensive relative to other items of comparable weight. Similar problems exist in storage of large quantities of foam articles, either in a warehouse or in a retail store; the large space taken up by the articles, particularly low-priced items, does not justify keeping a large inventory. Therefore, retail stores carrying items such as decorator pillows cannot afford to have a large selection of styles and sizes on hand, thereby reducing potential sales.

Therefore, it is an object of this invention to provide a rapid, simple method of reducing the volume of items fabricated from flexible foam material for shipping.

It is also an object of the invention to provide a novel method of packaging flexible foam objects.

It is a further object of the invention to provide an unusual gift product consisting of a compressed foam article in a structural container.

SUMMARY OF THE INVENTION

A method of packaging a flexible foam article comprises placing the article in a flexible substantially air-tight bag, and removing air from the bag. If the bag is to be packaged in a rigid container, the article is pressed into the rigid container as the air is removed, the compressed article then conforming to the shape of the inside of the container.

DETAILED DESCRIPTION OF THE INVENTION

Figure 1:
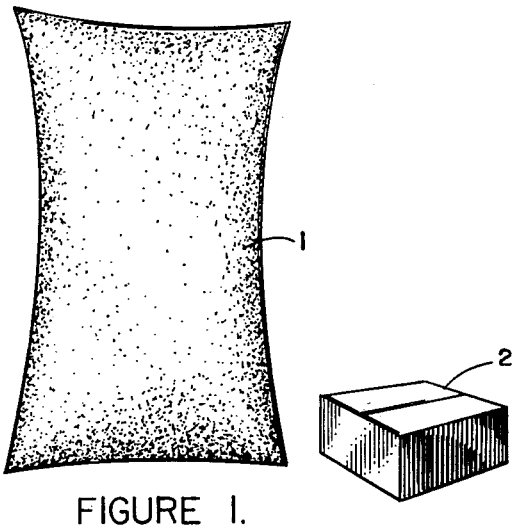
FIG. 1 shows a foam pillow and a gift box to be used to package the pillow.

Referring to FIG. 1, pillow 1 is a decorator pillow consisting of a cloth fabric covering stuffed with shredded, light-density flexible polyurethane foam. The pillow measures approximately 14 × 22, and is 8 thick at the center, averaging about 6 thick. The pillow is to be packaged in box 2, which measures 8 × 8 × 4. Accordingly, the pillow is compressed to less than 20% of its original volume during packaging.

Figure 2:
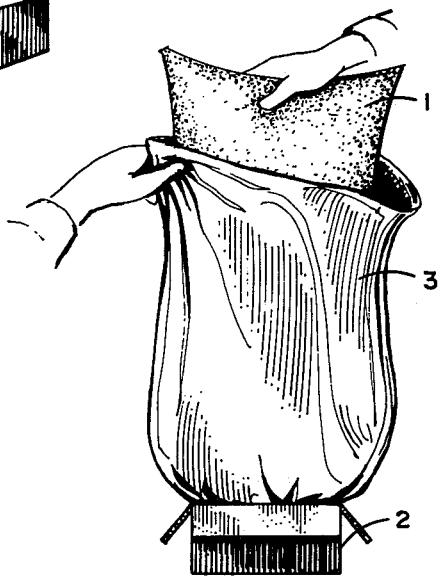
FIG. 2 shows the placement of the pillow in a plastic bag, and the placement of the bag bottom into the box.

To pack the pillow in the box, the pillow is first placed in flexible plastic bag 3, as shown in FIG. 2. The bag may be made from any material, such as polyethylene, polypropylene, or polyvinyl chloride film sheet, so long as the bag does not "breathe", i.e., is of a material such that air does not readily pass through the material. For example, a porous paper bag would not be acceptable since it would be unable to hold a vacuum. The bottom of the bag containing the pillow is then placed in box 2 to begin the packing procedure.

Figure 3:
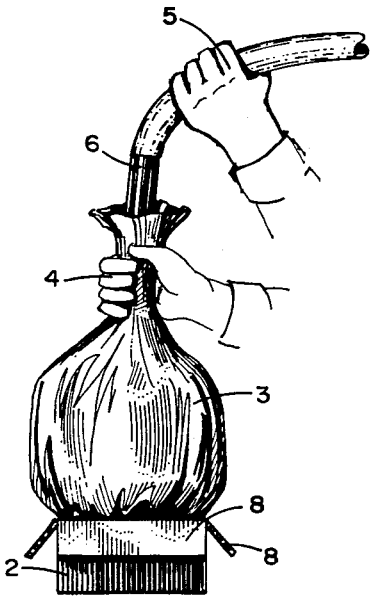
FIG. 3 illustrates the removal of air from the plastic bag by means of a vacuum pump.

The key step in packing the pillow in the box involves the removal of air from the bag by suction. The opening of bag 3 is drawn around the top of pillow 1, and the intake of a vacuum pump is inserted into the top of the bag. FIG. 3 indicates a manual packing operation where the operator's right hand 4 grasps the top of the bag, while the left hand 5 inserts the vacuum pump inlet hose 6 into the bag opening. The right hand then squeezes the bag around the hose nozzle to minimize leakage of air into the bag when the pump is in operation. As air is withdrawn from the plastic bag, the bag collapses. The air pressure outside of the bag compresses the sponge to a small fraction of its original volume. While some air leakage into the bag is expected, as long as the pressure differential between the inside and outside of the bag is greater than the pressure needed to substantially compress the sponge, the operation will be successful.

Figure 4:
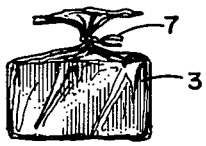
FIG. 4 shows the compressed pillow in the bag.

As the sponge is compressed, the operator will move his left hand 5 from the vacuum hose to the body of the bag, guiding the pillow into the box as the pillow shrinks. In this manner, the sponge is urged to conform to the inner shape of the box. When substantially all of the air has been drawn out of the bag, the pillow can be sealed in the box by simply closing the lid flaps 8 over the top of the box. Alternatively, the bag can first be taped, or tied with string or wire 7 as shown in FIG. 4, to prevent the pillow from popping out of the box during the sealing operation. After the bag is tied to prevent expansion of the pillow, the bag may be removed from the box (see FIG. 4) without losing its shape.

When the box is opened, and the tie (if any) on the bag is removed, the pillow immediately expands to its original size and shape, as shown in FIG. 1. The effect of the pillow popping out of the box is very surprising and pleasing to one who unsuspectingly opens the box, and the boxed pillow makes a delightful and unusual gift item. Unexpectedly, it has been found that even high quality fabric coverings for pillows are not wrinkled or damaged by packing in this manner, since the reexpansion of the foam stretches the fabric to eliminate any wrinkles from packaging. Any kind of fabric may be used as a covering for the foam, including long and short hair furs, plain or crushed velvet, tapestries, corduroy, cotton, or any synthetics. Any kind of decorative tassels or trim may also be used. The only qualification on acceptability of pillow covering is that the covering not be air-tight; if air cannot escape from the pillow, it cannot be compressed.

It is not essential to use a box to package the articles; for example, a decorative plastic bag may be used as the complete packaging. In this case, the bag may simply be secured with a tie around the opening. Alternatively, the bag may be secured by placing it in another type of closed container, such as a canister. After compression, it is not necessary for either the bag or the container to be air-tight.

The foam article to be compressed may be any object made from flexible foam, and may be in any shape.

Pillows of any size and shape, children's toys such as toy animals, foam chairs and small couches, can all be packaged in accord with the invention. In addition, the invention may be used for packaging very large bulk quantities of foam for shipping to a foam manufacturer to a fabricator; the foam may be in the form of bulk slabs, or may be baled shredded foam. Any kind of foam may be used, preferably low density foam, such as polyurethane, polystyrene, or latex rubber.

The vacuum pump may be any type of pump, e.g., centrifugal or reciprocating, which can create a sufficient pressure differential between the inside and outside of the plastic bag to compress the foam sponge material. For most flexible foam, only a small pressure differential is necessary; lightweight flexible polyurethane foams commonly used as pillow stuffing compressed to about 20% of their original volume under a pressure of about 1 psi, and generally to about 50% or more of their original volume at 0.5 psi. The minimum pressure differential would of course vary with the compressibility characteristics of the foam. It is desirable to compress the foam to less than 50% of its expanded volume, preferably less than 25%, and still more preferably less than 20% of its expanded volume. Higher volume reductions may be obtained with further pressure reductions, however, it is generally difficult and unnecessary to compress most foams to more than 10% of expanded volume.

For simple manual packaging of foam articles, an ordinary house vacuum cleaner has proved to be a very adequate source of vacuum. The vacuum cleaner inlet hose, which is between 1 inches and 2 inches in diameter, is easily grasped by the operator as shown in FIG. 3. However, many other types of pumps and methods of removing the air from the bag can be used. For example, the bag can be completely sealed around the foam object prior to removing the air; the vacuum pump can then be attached to and communicate with the inside of the bag through an air valve.

An alternative method of compression of the foam articles contemplates placement of the plastic bag encasement between the foam stuffing and the material covering of the article. In this arrangement, an air valve or other access to the sponge stuffing is left slightly protruding from the article when the covering fabric is sewn in place. The vacuum pump is attached to the valve for compression; for expansion, the valve is either opened or cut off to allow air to enter the foam stuffing.

The compression method of the invention is particularly adaptable to production of novel gifts consisting of compressed pillows or other objects which, when opened, pop out of the box to the surprise of the recipient. Pillows with gift messages on one side, such as "Happy Birthday", or other personalized words, initials, pictures, or verse, may be used in place of more traditional greeting cards. The pillows may have attractive fabric on one side, thereby enabling more permanent use as a decorator item. These gift items may also be packaged by other methods, e.g., by physical compression of the articles into a box.

Many variations of the invention described herein are possible within the basic concept of flexible foam compression, and the scope of the invention should be limited only by the following claims.

I claim:

1. A novelty gift comprising an article of fabric-covered flexible foam, the fabric being air permeable, said article being compressed to a volume no greater than 25% of its freely expanded volume, the article being contained in a flexible sack, fastening means for maintaining the sack in closed condition such that the article cannot expand until the fastening means is removed, and a rigid container for retaining the article compressed in the sack.

2. The novelty gift of claim 1 wherein the article is a pillow.

3. The novelty gift of claim 1 wherein the fabric contains a message printed thereon.

* * * * *